United States Patent [19]

Howell et al.

[11] Patent Number: 4,658,227

[45] Date of Patent: Apr. 14, 1987

[54] HIGH SPEED MAGNETIC CONTACT DRIVER

[75] Inventors: Edward K. Howell, Simsbury; Henry G. Willard, Wethersfield, both of Conn.

[73] Assignee: General Electric Company, New York, N.Y.

[21] Appl. No.: 839,671

[22] Filed: Mar. 14, 1986

[51] Int. Cl.[4] ..... H01H 9/20; H01H 71/24

[52] U.S. Cl. ..... 335/174; 335/16; 335/175; 200/147 R

[58] Field of Search ..... 335/176, 174, 6, 16, 335/147, 281, 175; 200/147 R

[56] References Cited

U.S. PATENT DOCUMENTS 3,407,368 10/1968 Heft et al. ..... 335/16

4,042,895 8/1977 Wafer ..... 335/174

4,292,611 9/1981 Bresson et al. ..... 335/174

*Primary Examiner*—Harold Broome

*Attorney, Agent, or Firm*—Richard A. Menelly; Walter C. Bernkopf; Fred Jacob

[57] ABSTRACT

A magnetic contact driver is arranged to drive a bridging contact out of electrical connection with a pair of fixed contacts to interrupt the current therethrough. The magnetic driver comprises a conductor winding embedded within notches in a plurality of metal laminations and an armature arranged transverse to the metal laminations. An auxiliary contact driver arrangement consisting of a pair of spaced electrical conductors arranged on the opposite side of the bridging contact is simultaneously energized for electrodynamic repulsion at the instant the magnetic driver winding becomes energized.

17 Claims, 7 Drawing Figures

HIGH SPEED MAGNETIC CONTACT DRIVER

BACKGROUND OF THE INVENTION

U.S. patent application Ser. No. 839,678, filed Mar. 14, 1986, entitled "High Speed Contact Driver For A Circuit Interruption Device", in the name of E. Keith Howell, describes the arrangement of a bridging contact carried by a pair of spaced parallel conductors and arranged between a pair of fixed contacts for rapid separation therefrom when a high current pulse is provided to the opposite ends of the spaced conductors. The spaced-conductor contact driver arrangement rapidly separates the bridging contact from the fixed contacts to interrupt the current in the early stages of the current wave form. The duration of contact separation is limited by heating of the spaced conductors, however.

It has since been determined that the duration of contact separation can be prolonged by means of a magnetic contact driver in combination with the spaced-conductor contact driver. Although simultaneous energization of the spaced-conductor contact driver and the magnetic contact driver increases the rate of acceleration of the bridging contact to allow for circuit interruption in even earlier stages of the current wave form, the magnetic driver may be used alone to provide both high-speed opening and prolonged duration of separation.

The use of a solenoid-driven armature, per se, to separate a bridging contact from a pair of fixed contacts for high speed circuit interruption is described within U.S. Pat. No. 3,407,368, entitled "Current Limiting Circuit Breaker" in the names of E. B. Heft et al., which patent is incorporated herein for purposes of reference. The Heft et al. patent describes a solenoid-drive armature for separating a bridging contact from a pair of fixed contacts within a current-limiting circuit breaker. The tubular armature described therein is arranged coextensive with a magnetic field piece to drive the armature against the bias of a compression type contact spring. The use of the compression contact spring and the coextensive arrangement of the field piece and the armature renders the Heft et al. arrangement too slow for purposes of arcless circuit interruption.

As described within the referenced patent application, for "Arcless" circuit interruption to occur, the bridging contact must be driven out of circuit relation with the current carrying fixed contacts in the shortest possible time duration in order to limit the amount of current that has to be controlled by auxiliary electronic means such as the solid state circuit interrupter described within U.S. patent application Ser. No. 610,947, filed May 16, 1984, entitled "Solid State Current Limiting Interrupter", for example. The magnetic operator of the instant application substantially improves over earlier known devices by accelerating the bridging contact out of electrical connection with the fixed contacts faster than any method previously available.

SUMMARY OF THE INVENTION

A magnetic contact operator is arranged for driving a bridging contact out of electrical connection with a pair of fixed contacts. A compression spring on one side of the bridging contact holds the bridging contact in good electrical connection with the fixed contacts. An alternative arrangement utilizes a parallel conductor-contact driver which is simultaneously energized with the magnetic operator for extremely fast contact acceleration. The magnetic operator is arranged on the opposite side of the bridging contact to drive the bridging contact out of electrical connection with the fixed contacts against the contact bias provided by the compression spring.

DESCRIPTION OF THE PREFERRED EMBODIMENT

Figure 1:
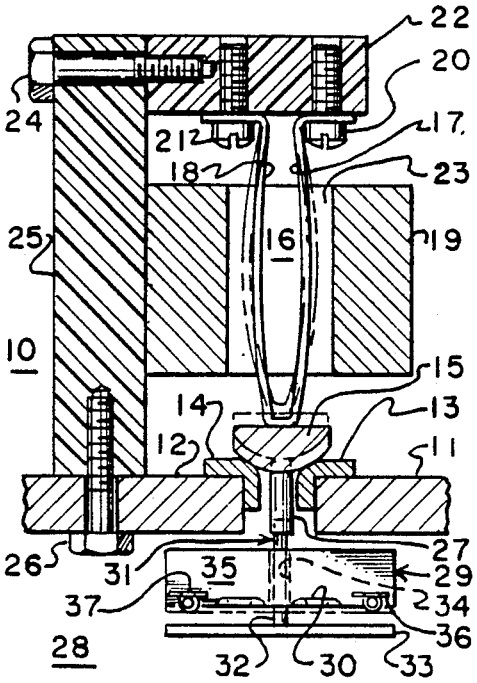
FIG. 1 is a side view, in partial section, of a contact arrangement utilizing the magnetic operator according to the invention.

Referring to FIG. 1, as described within the aforementioned patent applications, a circuit interrupter 10 for extremely fast circuit interruption, shown in FIG. 1, is provided by the arrangement of a pair of conductors 11, 12 terminating in a corresponding pair of fixed contacts 13, 14. A bridging contact 15, is carried by a spaced-conductor contact driver 16 which comprises a pair of spaced parallel wires 17, 18 arranged within a slot 23 of a magnetic structure 19. Electrical connection is made with the contact driver at an opposite end by means of a pair of terminals 20, 21. The terminals are arranged on one side of an insulating block 22 which is fastened to a support post 25 by means of a screw 24. The bottom of the support post 25 is fastened to the conductor 12 by means of a screw 26. When a high current pulse of short duration is applied to the conductors by means of the terminals 20, 21, the spaced parallel wires 17, 18 become electrodynamically repulsed and correspondingly lift the bridging contact out of electrical connection with the fixed contacts, as shown in phantom. To minimize the current and energy of an arc between the bridging contact 15 and the fixed contacts 13, 14 upon separation of the bridging contact therefrom, the separation should occur in the shortest possible time. The minimum time for separation of contacts is obtained by operating with the highest current pulse of shortest duration and with wires of smallest diameter consistent with maintaining adequate mechanical strength of the wires within the temperature rise produced by the current pulse. Thus the spaced-conductor contact driver has an inherent thermal limitation to the length of time current can be maintained in the wires to sustain separation of the bridging contact from the fixed contacts. To increase the duration of separation of the bridging contact from the fixed contacts, a magnetic operator 28 is arranged on the side of the bridging contact opposite the spaced-conductor contact driver 16. The magnetic operator consists of a stator 29, which encompasses a single wire turn 30 arranged in a convoluted path within notches in a magnetic material such as ferrite or a plurality of magnetic metal laminations 35, and a magnetic armature plate 33 which acts upon a driving pin 32 terminating with an insulated sleeve 27 positioned within a hole 34 arranged through the stator. A pair of magnetic operator terminals 36, 37 allow ease in attachment to the ends of the copper wire.

Figure 2:
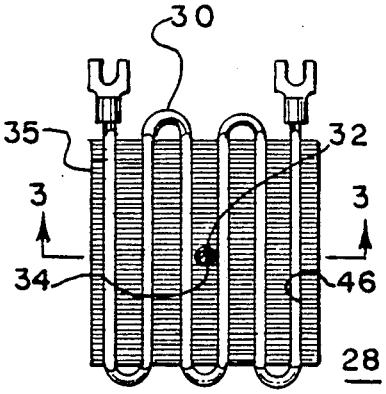
FIG. 2 is a bottom view of the magnetic operator depicted in FIG. 1.
Figure 3:
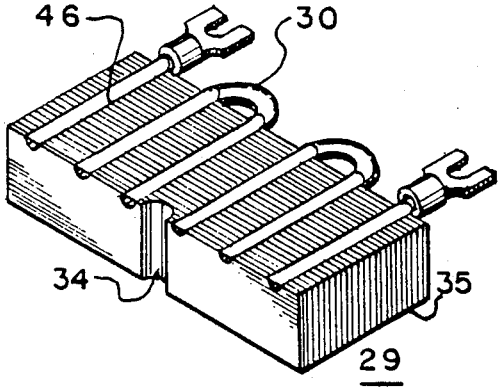
FIG. 3 is a top perspective view, in partial section, of the magnetic operator depicted in FIG. 2.

The magnetic operator 28 with the armature plate 33 removed is shown in FIG. 2 with the wire turn 30, which can comprise a single convoluted turn of heavy gauge copper wire or many turns of smaller wire, arranged in a labyrinth arrangement within slots in the surface of the stator, with a driving pin hole 34 arranged transversely through the labyrinth for the transverse motion therein of the driving pin 32. The magnetic metal laminations 35 are notched to receive the wire turn and are bonded together in a single stack configuration with the notches forming a labyrinth groove 46 for receiving the wire turn 30 within the metal laminations 35. The notches 46 in the laminations and the transverse arrangement of the driving pin hole 34 is best seen by referring to the sectional view depicted in FIG. 3 with the armature and driving pin removed.

Figure 4:
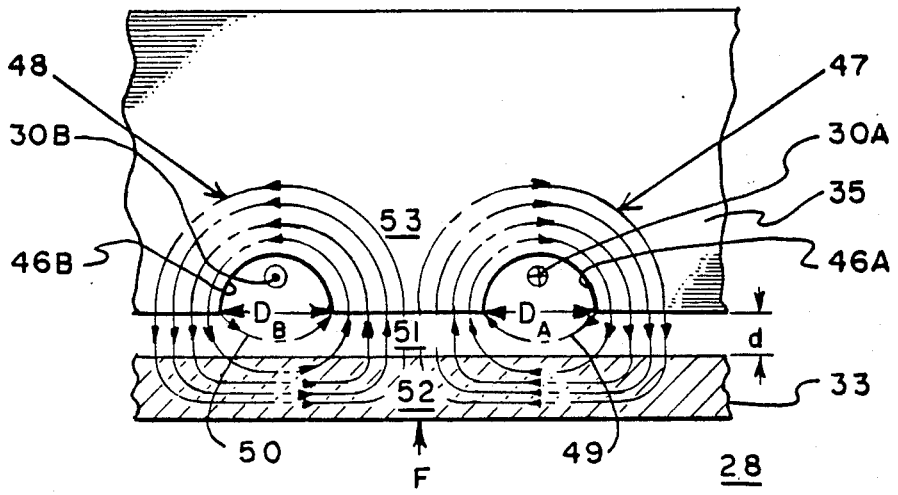
FIG. 4 is an enlarged end view of the magnetic operator of the invention illustrating the direction of the magnetic flux lines induced therein.

The magnetic field direction within the magnetic operator 28 can be seen by referring to FIG. 4 wherein one metal lamination 35 is depicted with respect to the armature plate 33. The wire turn 30A within labyrinth slot 46A is depicted with the direction of current transferring into the plane of the paper and the width of the slot is represented by the dimension $D_A$. The magnetic flux lines 47 generated within the metal lamination about the wire turn 30A are oriented in the clockwise direction as indicated and the magnetic flux lines 48 generated about wire turn 30B are in the indicated counterclockwise direction. A fringing flux 49 in front of slot 46A extends partially within the gap 51 separating the armature plate 33 from the lamination. A similar fringing flux 50 in front of slot 46B extends partially within the gap as illustrated. The parallel arrangement of the plane of the armature plate to the plane of the laminations is an important feature of this invention. As noted by the indicated directions of flux lines 47, 48, they additively combine with the region 52 within the armature plate and with the region 53 defined within the laminations intermediate the adjacent slots. The attractive force F exerted between the armature plate and the laminations corresponding to the lines of magnetic flux is shown to be concentrated in regions 52, 53. The arrangement advantageously allows a large amount of magnetic flux to be generated within relatively thin laminations and within a relatively thin armature plate without reaching magnetic saturation. This allows the magnetic operator to find further application outside of the circuit breaker field where fast linear response to an electric pulse is required, such as high speed photography and ink jet printing applications, for example. Relatively negligible fringing flux occurs when the slot width $D_A$ $D_B$ is approximately twice the thickness d of the gap 51 separating the magnetic laminations from the armature plate.

The circuit interrupter 10, seen by referring back to FIG. 1, can be operated under a variety of conditions. Both the spaced-conductor contact driver 16 and the magnetic operator 28 can be energized independently if so desired. Current can be maintained in the magnetic operator, without excessive heating thereof, sufficient to hold the bridging contact separated from the fixed contacts for a duration long enough to allow an auxiliary switch of normal speed, in series with conductors 11 and 12, to open and isolate the circuit. For extremely fast circuit interruption, both the spaced-conductor contact driver and the magnetic operator can be simultaneously energized by applying a current pulse to the spaced-conductor contact driver terminals 20, 21 and to the magnetic operator terminals 36, 37 at the same instant. The spaced parallel wires 17, 18 can be replaced with a pair of spring wires having the same configuration, but being spring-loaded in compression between the insulating block 22 and the fixed contacts to provide a contact closing force between the fixed and movable contacts to decrease the contact resistance therebetween. The pulse duration of the electric current pulse applied to the magnetic operator 28 will then determine both the speed of opening and the duration of separation between the bridging contact and the fixed contacts to ensure that they remain separated until the auxiliary switch is opened to clear the circuit.

Figure 5:
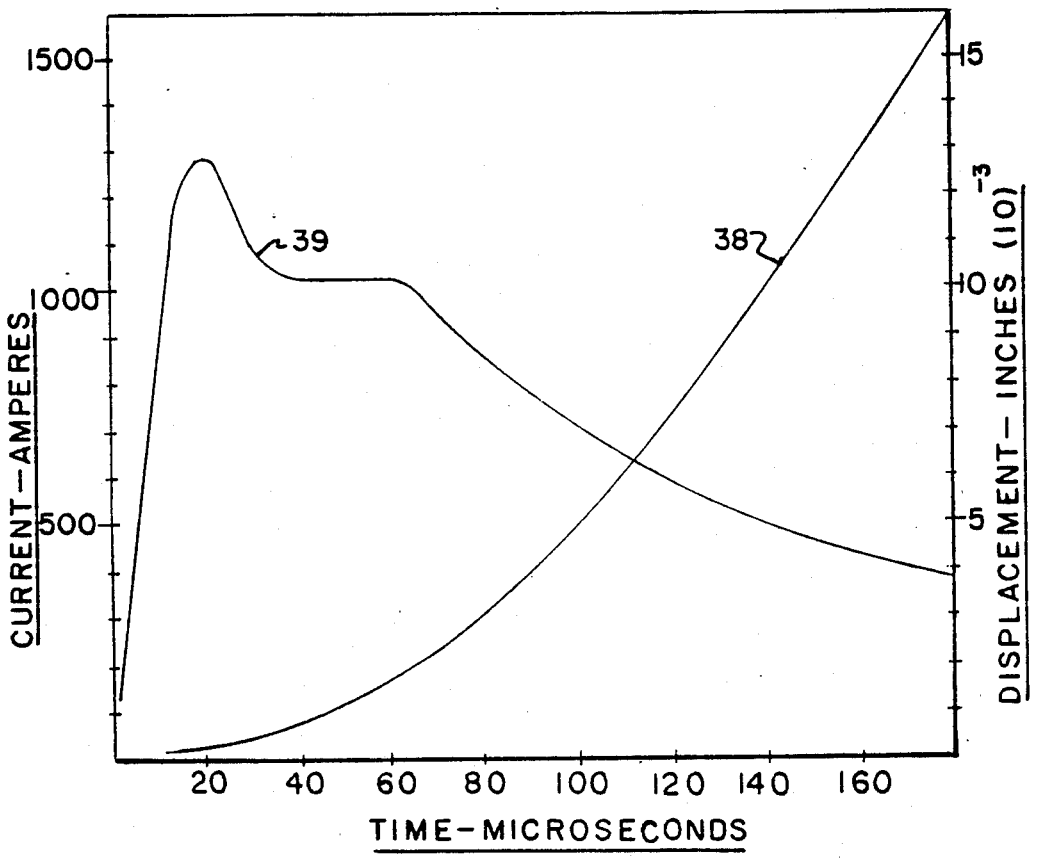
FIG. 5 is a graphic representation of the bridging contact displacement as a function of drive current and time.

The time relation between the displacement 38 of the bridging contact and the ampere value 39 of the energizing current pulse supplied to the magnetic operator 28, operating alone without the spaced-conductor driver, can be seen by referring now to FIG. 5. It is noted that some time is required for the current pulse to reach a predetermined maximum value and that some additional time is required for the armature and driving pin to respond thereto. For an armature and driving pin displacement of 5 thousandths of an inch, for example, approximately 100 microseconds time is involved. The rapid displacement of the armature and driving pin results in a corresponding rapid separation of the bridging contact 15 away from the fixed contacts 13, 14 which allows the current between the fixed contacts to be interrupted in the very early stages of the current wave form such that the amount of switching current is substantially reduced.

Figure 6:
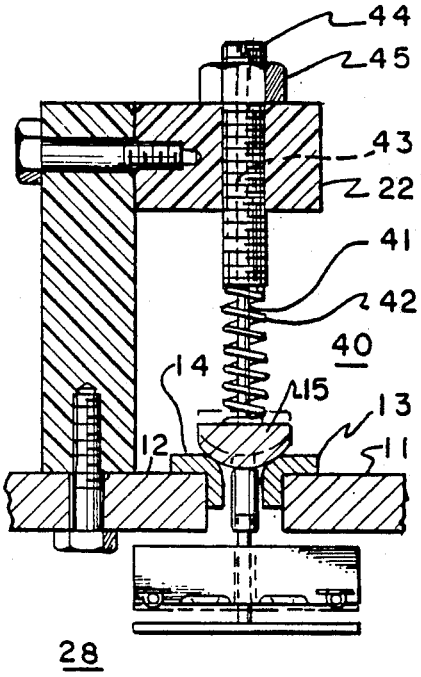
FIG. 6 is a side view, in partial section, of an alternate contact arrangement using the magnetic operator according to the invention.

A simplified circuit interrupter 40 is shown in FIG. 6 wherein the bridging contact 15 is arranged between the fixed contacts 13, 14 and the magnetic operator 28 is arranged on the opposite side of the bridging contact. A support rod 41 is arranged within a compression spring 42 and is attached to the bridging contact 15 at one end and allowed to slide within a hole 43 arranged within a bolt 44 which holds the compression spring against the bridging contact to provide contact closing force between the fixed contacts and the bridging contact. The bolt is attached to a threaded hole in the insulating block 22 and secured by means of a nut 45, arranged for adjusting the compression exerted on the bridging contact. The magnetic operator 28 operates to drive the bridging contact out of electrical connection with the fixed contacts in the same manner as described earlier with respect to the circuit interrupter depicted in FIG. 1.

Figure 7:
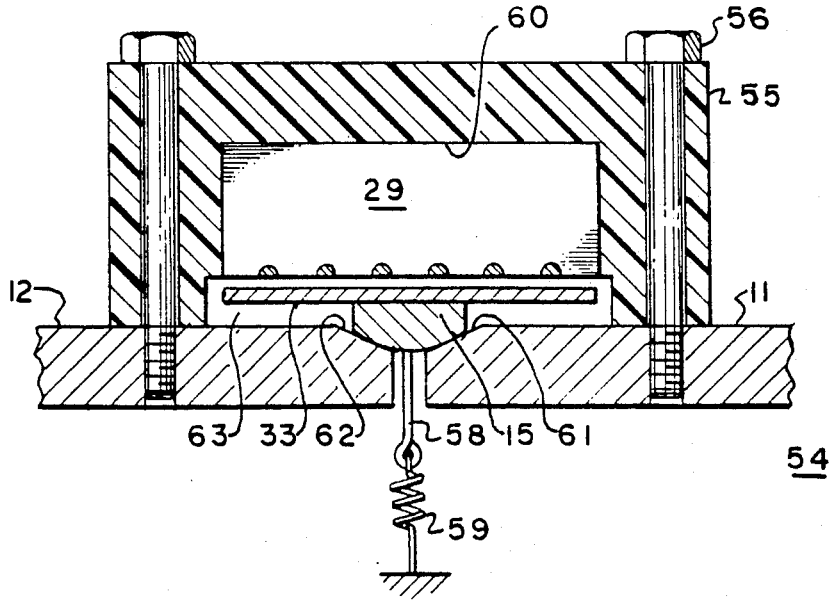
FIG. 7 is a side view in partial section of a further embodiment of a contact arrangement using the magnetic operator according to the invention.

A fast acting compact circuit interrupter 54 is depicted in FIG. 7 with the conductors 11, 12 attached to an insulative support 55 by means of bolts 56. The stator 29 of the magnetic operator is arranged within the opening 60 defined by the insulative support and the armature plate 33 is directly fastened to the bridging contact 15 by welding or soldering. The contact pressure between the bridging contact and the contoured ends 61, 62 of the conductors is supplied by a tension spring 59 attached to the bridging contact by means of a connector 58. The fixed contacts are the contoured ends of the conductors. The compact arrangement of the stator, bridging contact and armature plate allows the circuit interrupter to be enclosed within an evacuated or dielectric gas-filled sealed container. In lieu of the driving pin used with the magnetic operators depicted in FIGS. 1 and 6, the armature plate would immediately be attracted to the stator carrying the bridging contact simultaneously out of electrical connection with the conductors. Should the enclosure 63 within the vicinity of the bridging contact and contoured ends of the conductors be evacuated, the bridging contact would only have to be separated from the contoured ends by a few thousandths of an inch to break the electrical connection without fear of arcing. The dielectric gas or vacuum environment also protects the bridging contact and contoured ends of the conductors from oxidizing should aluminum, nickle, brass or copper be employed to form the bridging contact as well as the conductors themselves.

It has thus been shown that an extremely fast response actuator having an armature plate proximate a planar stator can be used within circuit interrupters and other switching devices where size, speed and economics are important considerations.

Having thus described our invention, what we claim as new and desire to secure by Letters Patent is:

1. A circuit interrupter comprising:

a pair of fixed contacts and a bridging contact arranged for electrically disconnecting an electric path between said fixed contacts; and a magnetic operator arranged for moving said bridging contact and disconnecting said electric path, said magnetic operator comprising a stator consisting of a magnetic material having a plurality of notches with a metal conductor lying in said notches and a magnetic armature plate extending proximate said conductor and said notches, said armature being also arranged proximate said bridging contact for striking said bridging contact and driving said bridging contact away from said fixed contacts to thereby disconnect said electric path when a first current pulse is applied to opposite ends of said metal conductor.

2. The circuit interrupter of claim 1 further including a spaced-parallel pair of conductors supporting said bridging contact from a side of said bridging contact opposite said armature, said pair of electrical conductors being arranged for electrodynamic repulsion upon excitation by means of a second current pulse to move said bridging contact away from said fixed contacts.

3. The circuit interrupter of claim 2 wherein said first current pulse is applied to opposite ends of said conductor the same time said second current pulse is applied to said pair of conductors to further accelerate the separation of said bridging contact from said fixed contacts.

4. The circuit interrupter of claim 1 wherein said magnetic material comprises a plurality of magnetic metal laminations.

5. The circuit interrupter of claim 2 further including at least one contact spring arranged on said side of said bridging contact opposite said armature for holding said bridging contact in electrical connection with said fixed contacts.

6. The circuit interrupter of claim 1 wherein said metal conductor is arranged in a labyrinth path within said magnetic material.

7. The circuit interrupter of claim 6 wherein said metal conductor comprises a convoluted path in the same plane and wherein said hole is arranged through said magnetic material proximate a center of said convoluted path.

8. The circuit interrupter of claim 1 wherein said bridging contact, said fixed contacts and said magnetic operator are within a sealed enclosure.

9. The circuit interrupter of claim 8 wherein said enclosure is evacuated.

10. The circuit interrupter of claim 8 wherein said enclosure contains an insulating gas.

11. A magnetic operator for providing impact motion under control of an electric pulse comprising:

a planar stator arranged in a first plane;

a planar armature plate arranged proximate said stator in said same plane;

a continuous conductor arranged on said stator in a labyrinth path;

means defining an opening through said stator perpendicular to said first plane; and a driving pin within said opening and arranged for contact by said armature plate when a current pulse is applied to said continuous conductor.

12. The magnetic operator for providing motion under control of an electric pulse of claim 11 wherein said stator comprises a plurality of notched magnetic laminations, said laminations being arranged to define a labyrinth path within said first plane.

13. The magnetic operator for providing motion under control of an electric pulse of claim 11 wherein said driving pin is fixedly attached to said armature plate.

14. A compact high speed circuit interrupter comprising:

a bridging contact arranged proximate a pair of separated conductors for making and breaking an electric path between said separated conductors;

a stator arranged in a first plane proximate said bridging contact and said separated conductors, said stator comprising a plurality of metal laminations defining a labyrinth slot, with a metal conductor being arranged within said labyrinth slot; and a magnetic armature plate arranged in said first plate intermediate said stator and said separated conductors, said bridging contact being fixedly attached to one side of said magnetic armature plate for moving said bridging contact away from said separated conductors when an electric pulse is applied to said metal conductor.

15. The compact high speed circuit interrupter of claim 14 wherein said stator, armature and separated conductors are arranged within an evacuated enclosure.

16. The compact high speed circuit interrupter of claim 14 wherein said stator, armature and separated conductors are arranged within a dielectric gas-filled enclosure.

17. The compact high speed circuit interrupter of claim 16 wherein said gas comprises $SF_6$.

* * * * *